US010300593B2

(12) United States Patent
Wang

(10) Patent No.: US 10,300,593 B2
(45) Date of Patent: May 28, 2019

(54) PAINT BRUSH AND A CLAMPING AND LOCATING DEVICE USED IN THE SAME

(71) Applicant: SHANGHAI LIMACH MANUFACTURING CO., LTD, Shanghai (CN)

(72) Inventor: Fuying Wang, Shanghai (CN)

(73) Assignee: SHANGHAI LIMACH MANUFACTURING CO., LTD, Shanghai (CN)

( * ) Notice: Subject to any disclaimer, the term of this patent is extended or adjusted under 35 U.S.C. 154(b) by 222 days.

(21) Appl. No.: 15/402,256

(22) Filed: Jan. 10, 2017

(65) Prior Publication Data

US 2017/0197307 A1 Jul. 13, 2017

(30) Foreign Application Priority Data

Jan. 11, 2016 (CN) ..... 2016 2 0020633 U

(51) Int. Cl.

| | |
|---|---|
| ***B05C 17/00*** | (2006.01) |
| ***B05C 17/02*** | (2006.01) |
| ***B25G 3/10*** | (2006.01) |
| ***A46B 9/00*** | (2006.01) |
| ***B25G 3/38*** | (2006.01) |

(52) U.S. Cl.

CPC ..... *B25G 3/10* (2013.01); *A46B 9/005* (2013.01); *B25G 3/38* (2013.01); *A46B 2200/202* (2013.01); *B05C 17/00* (2013.01); *B05C 17/02* (2013.01)

(58) Field of Classification Search

CPC ..... B05C 17/00; B05C 17/0222; B05C 17/00589; B25G 3/10; B25G 3/38

See application file for complete search history.

(56) References Cited

U.S. PATENT DOCUMENTS

| | | | | |
|---|---|---|---|---|
| 4,219,899 A * | 9/1980 | Zurawin | B05C 17/00 | 15/144.2 |
| 4,300,258 A * | 11/1981 | Burns | A46B 5/02 | 15/145 |
| 6,554,902 B2 * | 4/2003 | Yan | B05B 17/00 | 118/264 |
| 2005/0207820 A1 * | 9/2005 | Franczak | A47J 37/0786 | 401/39 |

FOREIGN PATENT DOCUMENTS

| | | | |
|---|---|---|---|
| GB | 2298379 A * | 9/1996 | B05C 17/00 |

* cited by examiner

*Primary Examiner* — Michael D Jennings
(74) *Attorney, Agent, or Firm* — Mark M. Friedman

(57) ABSTRACT

A paint brush and a clamping and locating device used in the same are provided. The clamping and locating device comprises a base, a handle and a lock button. The base includes a mounting surface, a handle-retaining cavity and at least one boss. The handle has a head portion being held in the handle-retaining cavity. The head portion includes at least one mounting hole, a button-receiving recess and a sliding groove. The button-receiving recess is divided into a first position and a second position. The mounting hole and the boss are axially mated together to make the handle be pivotally mounted in the handle-retaining cavity. The lock button is mounted in the button-receiving recess, and can be switched between the first position and the second position, so the handle is capable of being positioned on the first position and the second position.

9 Claims, 6 Drawing Sheets

PAINT BRUSH AND A CLAMPING AND LOCATING DEVICE USED IN THE SAME

BACKGROUND OF THE INVENTION

1. Field of the Invention

The present invention relates to a paint brush field, and more particularly to a paint brush and a clamping and locating device used in the same.

2. Description of the Prior Art

For a traditional paint brush, the angle between a handle and a brush plate is fixed. It limits the application of the paint brush and makes the user be inconvenient. There also exists the other traditional paint brush, the angle between the handle and the brush plate is not fixed and cannot be exactly controlled, so this also limits the application of the paint brush. Moreover, because the brush plate of the traditional paint brush is not removable and replaceable, the cleaning and maintenance of the paint brush will be trouble, and on the other hand, it is not conducive to the repeated use of materials and environmental protection.

BRIEF SUMMARY OF THE INVENTION

One object of the present invention is to provide a paint brush, a brush plate of which can be easily removed and installed and can be reliably and safely loaded, and a handle of which can be positioned at a first position and a second position.

The other object of the present invention is to provide a clamping and locating device used in a paint brush, which can make the brush plate be easily removed and installed and make the brush plate be reliably and safely loaded, and a handle of which can be positioned at a first position and a second position.

To achieve the above object of the present invention, the present invention adopts the following technical solution.

The present invention provides a clamping and locating device used in a paint brush, which comprises a base, a handle and a lock button. The base includes a mounting surface being used to be combined with a brush plate, a handle-retaining cavity formed on the mounting surface, and at least one boss on an inner wall of the handle-retaining cavity. The handle is used as a holding portion of the clamping and locating device and has a head portion being held in the handle-retaining cavity. The head portion includes at least one mounting hole on the side of the head portion, a button-receiving recess on the top of the head portion, and a sliding groove on the bottom of the button-receiving recess. The button-receiving recess is divided into a first position and a second position. The mounting hole and the boss are axially mated together to make the handle be pivotally mounted in the handle-retaining cavity. The lock button is mounted in the button-receiving recess and has a sliding protrusion, which enters into the sliding groove and can slide along the sliding groove. The lock button is switched between the first position and the second position under the control of the sliding protrusion, and the handle is capable of being positioned on the first position and the second position.

Further, the base further includes an elastic fastener disposed on one side of the mounting surface, and the elastic fastener can enter into and be held in a lock opening of the brush plate for fixing the base to the brush plate.

Further, the handle further disposes a torsion spring on the side of the head portion, the base further disposes a retaining groove on the bottom of the handle-retaining cavity, the torsion spring can be fixed by the retaining groove and can automatically reset the handle by the resilience performance of the torsion spring after rotating the handle.

Further, the handle further disposes a locating groove on the side of head portion, and the torsion spring is located by the locating groove.

Further, the head portion disposes several positioning grooves, which are formed on the bottom of the button-receiving recess and are perpendicular to the sliding groove; the positioning grooves divide the button-receiving recess into the first position and the second position; the lock button has a positioning rib, which can be engaged with one of the positioning grooves for positioning the handle on the first position and the second position.

Further, the lock button further has a stopping plate on the bottom of the sliding protrusion and an upper portion on the top of the sliding protrusion, and the stopping plate and the upper portion are located on two opposite sides of the sliding groove to prevent the lock button from leaving the sliding groove.

Further, the inside of the handle is hollow.

Further, the base further includes two bosses, which are respectively and symmetrically located on two opposite inner walls of the handle-retaining cavity; and the head portion disposes two mounting holes, which are respectively located on two opposite sides of the head portion and can be axially mated with the two bosses.

The present invention also provides a paint brush, which comprises a brush plate and a clamping and locating device used in the same.

Further, the brush plate disposes two guiding slots respectively located on two opposite edges thereof; and the mounting surface of the base slides into the two guiding slots.

In the present invention, the paint brush and the clamping and locating device used in the same have the advantages that: the brush plate can be easily removed and installed and can be reliably and safely loaded, and the handle can be positioned at a first position and a second position. The design of the present invention can ensures that it is more convenient and flexible to use, and the compact structure design can further ensure the safety and reliability of the product, improve the production efficiency, shorten the processing time and reduce the cost of product.

DETAILED DESCRIPTION OF THE PREFERRED EMBODIMENTS

The following embodiments with reference to the accompanying drawings now have been given for detail describing a paint brush and a clamping and locating device used in the same provided by the present invention.

Figure 1:
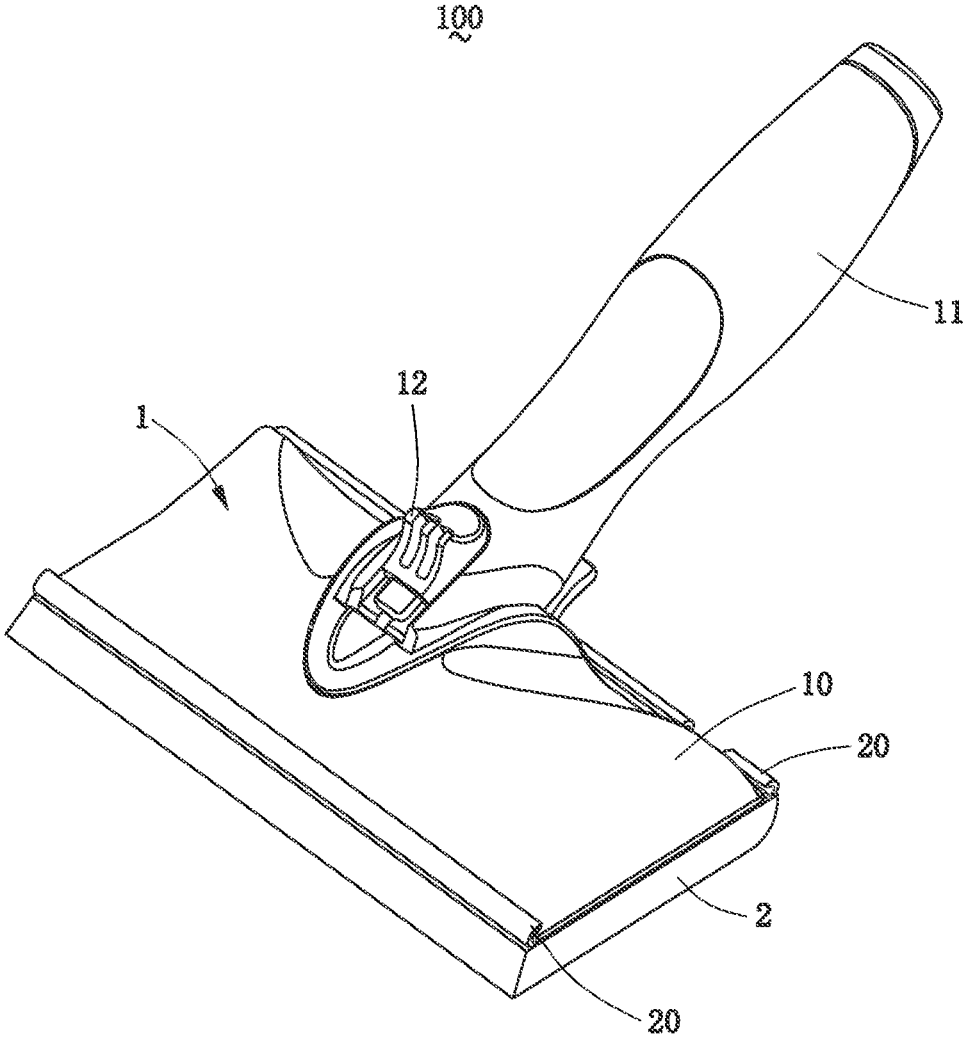
FIG. 1 is a perspective view of a paint brush of the present invention.

Referring to FIG. 1, a paint brush 100 of the present invention includes a clamping and locating device 1 and a brush plate 2. The brush plate 2 disposes two guiding slots 20 respectively located on two opposite edges thereof in order to facilitate the combination of the brush plate 2 and the clamping and locating device 1. The clamping and locating device 1 includes a base 10, a handle 11 and a lock button 12.

Figure 2:
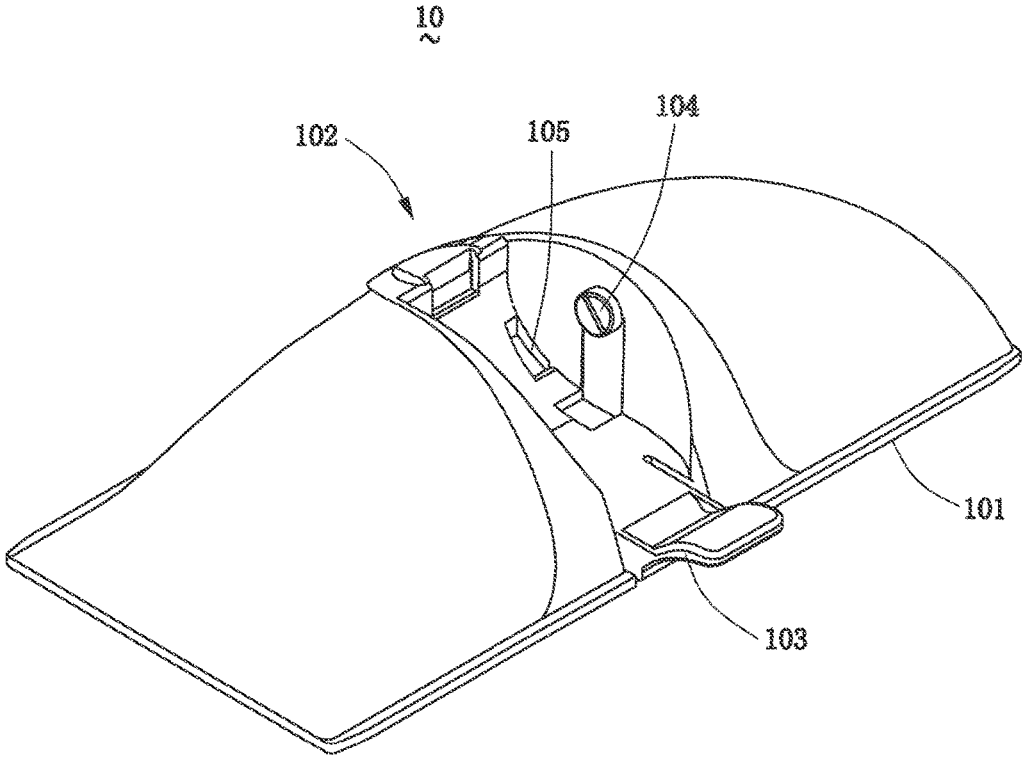
FIG. 2 is a perspective view of a base of a clamping and locating device of the present invention.
Figure 3:
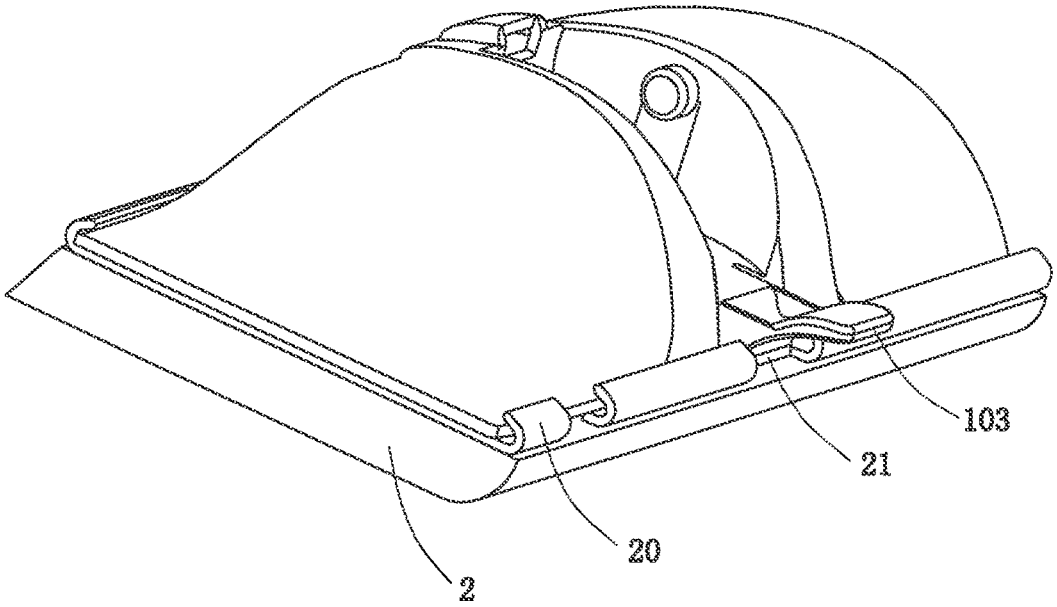
FIG. 3 is a schematic view of the base and a brush plate after combined.

Referring to FIGS. 2 and 3, the base 10 includes a mounting surface 101, a handle-retaining cavity 102 formed on the mounting surface 101 and an elastic fastener 103 disposed on one side of the mounting surface 101. The base 10 further includes at least one boss 104 on an inner wall of the handle-retaining cavity 102, and a retaining groove 105 on the bottom of the handle-retaining cavity 102.

The mounting surface 101 is used to be combined with the brush plate 2. Specifically, the mounting surface 101 is adhered to one surface of the brush plate 2, and some brush elements (not shown) are disposed on the other surface of the brush plate 2. The mounting surface 101 of the base 10 can slide into the two guiding slots 20. There forms a lock opening 21 on one of the guiding slots 20. The elastic fastener 103 can enter into and be held in the lock opening 21, thereby making the base 10 and brush plate 2 be fixed together and preventing the base 10 and the brush plate 2 from moving relatively. When removing, the elastic fastener 103 can be pressed to withdraw from the lock opening 21, and then the brush plate 2 can be taken out by moving the brush plate 2.

Figure 4:
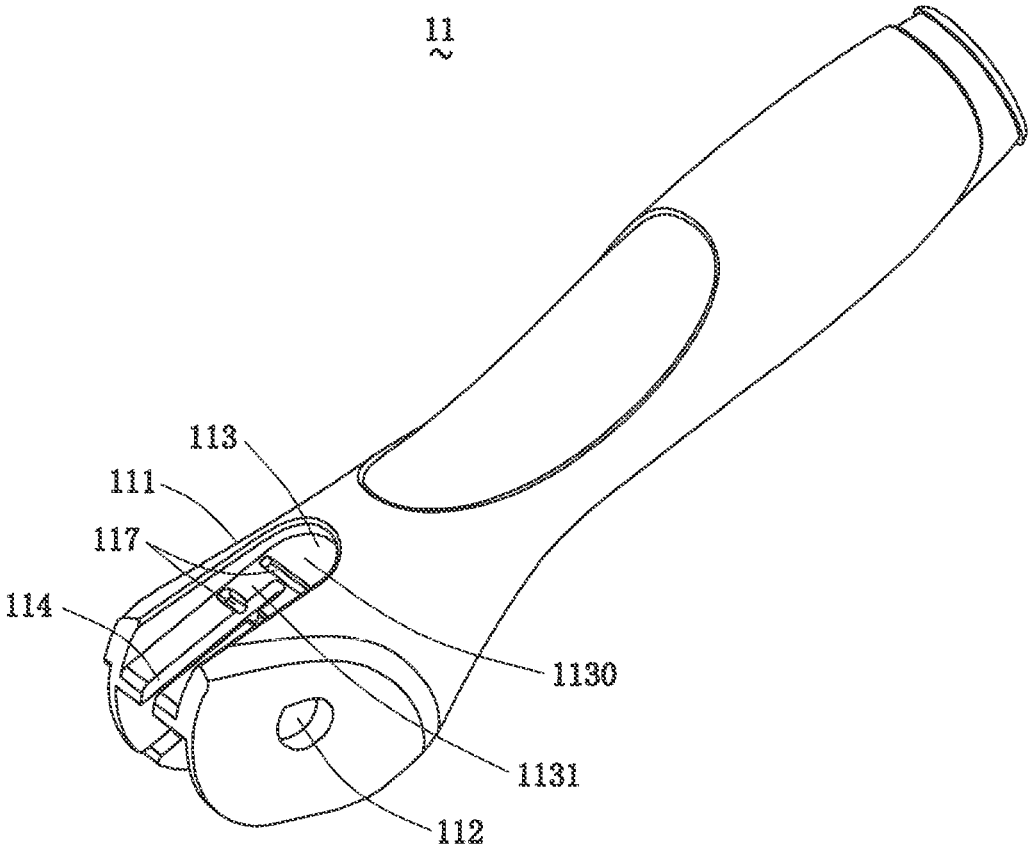
FIG. 4 is a perspective view of a handle of the clamping and locating device of the present invention.

Referring to FIG. 4, the handle 11 is used as a holding portion of the clamping and locating device 1, and the inside of the handle 11 is hollow. The handle 11 has a head portion 111, which can be held in the handle-retaining cavity 102. The head portion 111 has at least one mounting hole 112 on the side thereof, which can be axially mated with the boss 104 (shown in FIG. 2).

In the embodiment, there form two bosses 104 respectively and symmetrically located on two opposite inner walls of the handle-retaining cavity 102, but only one of the two bosses 104 is shown in FIG. 2, and the other thereof is not shown due to the perspective in viewing the base 10. Referring to FIG. 4, the head portion 111 disposes two mounting holes 112 respectively located on two opposite sides of the head portion 111. When the handle 11 is pivotally mounted in the handle-retaining cavity 102, the handle 11 can be rotated freely in a certain range by taking the two bosses 104 as a rotating shaft.

Please refer to FIG. 4, the head portion 111 disposes a button-receiving recess 113 on the top of the head portion 111 to be used for receiving the lock button 12. The head portion 111 further disposes a sliding groove 114 and several positioning grooves 117 on the bottom of the button-receiving recess 113. The positioning grooves 117 are perpendicular to the sliding groove 114. In the embodiment, there form two positioning grooves 117 on the bottom of the button-receiving recess 113, and the button-receiving recess 113 is divided into a first position 1130 and a second position 1131 by the positioning grooves 117.

Figure 5:
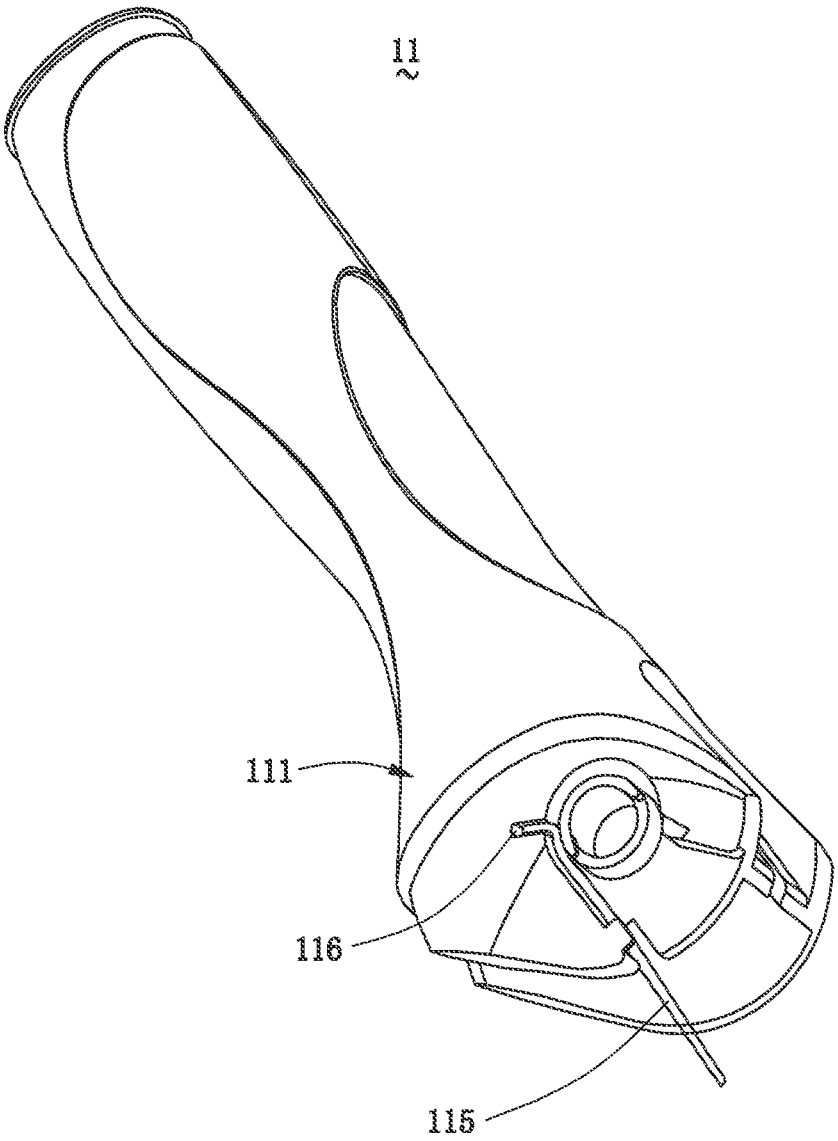
FIG. 5 is another perspective view of the handle of the clamping and locating device of the present invention.

Please refer to FIG. 5, the handle 11 further disposes a torsion spring 115 and a locating groove 116 on the side of the head portion 111. One end of the torsion spring 115 is placed in the locating groove 116, and the other end of the torsion spring 115 can be inserted into the retaining groove 105 of the base 10 (seen in FIG. 2). Namely, the retaining groove 105 can be used to fix the torsion spring 115. The torsion spring 115 can automatically reset the handle by the resilience performance of the torsion spring 115 after rotating the handle 11.

Figure 6:
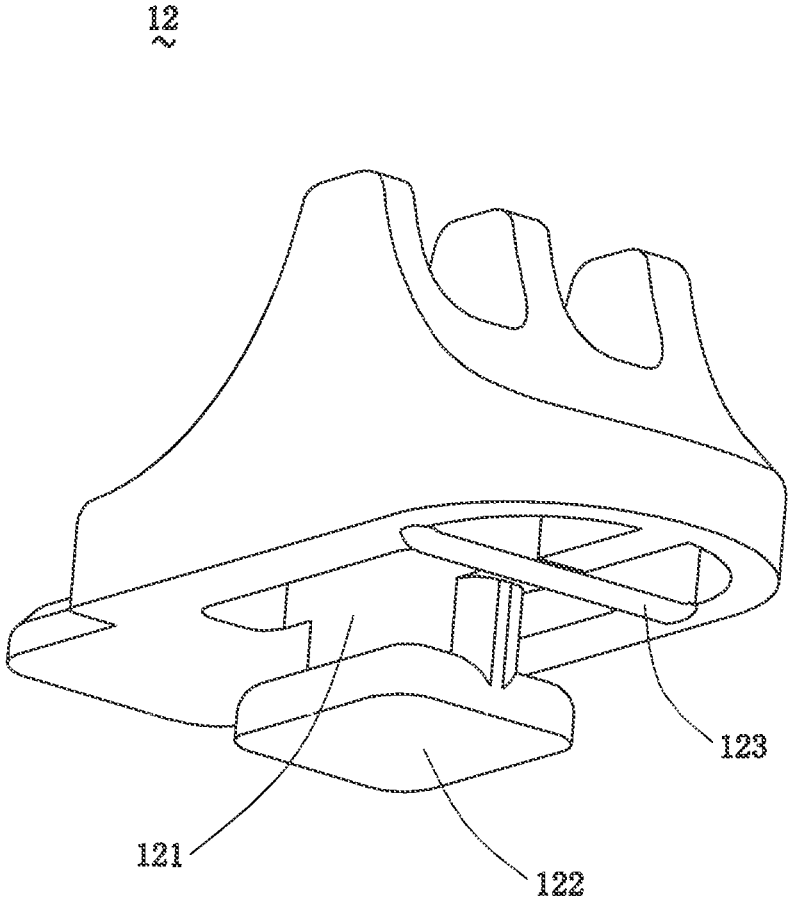
FIG. 6 is a perspective view of a lock button of the clamping and locating device of the present invention.

Please refer to FIG. 6, the lock button 12 can be mounted in the button-receiving recess 113 of FIG. 4. The lock button 12 has an upper portion 120, a sliding protrusion 121 located under the upper portion 120 and a stopping plate 122 located on the bottom of the sliding protrusion 121. The sliding protrusion 121 can enter into the sliding groove 114 of FIG. 4, and the upper portion 120 and the stopping plate 122 are located on upper and lower sides of the sliding groove 114, so that the lock button 12 can be prevented from leaving the sliding groove 114.

Referring to FIGS. 4 and 6, the lock button 12 further has a positioning rib 123, which can be engaged with the corresponding positioning groove 117 for positioning the handle 11, on the bottom of the upper portion 120. The sliding protrusion 121 can slide along the sliding groove 114, so the lock button 12 can be switched between the first position 1130 and the second position 1131 under the control of the sliding protrusion 121. Further, the handle 11 can be positioned on the first position 1130 and the second position 1131.

Referring to FIGS. 4 and 6, the lock button 12 can slide along a front and rear direction in the button-receiving recess 113 of the handle 11, so the handle 11 can be positioned at a desired angle and be fixed on the base 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

REFERENCE SIGNS LIST

100 paint brush
1 clamping and locating device
10 base
101 mounting surface
102 handle-retaining cavity
103 elastic fastener
104 boss
105 retaining groove
11 handle
111 head portion
112 mounting bole
113 button-receiving recess
1130 first position
1131 second position
114 sliding groove
115 torsion spring
116 locating groove
117 positioning groove
12 lock button
120 upper portion
121 sliding protrusion
122 stopping plate
123 positioning rib
2 brush plate
20 guiding slots
21 lock opening

What is claimed is:

1. A clamping and locating device used in a paint brush, comprising:

a base including a mounting surface being used to be combined with a brush plate, a handle-retaining cavity formed on the mounting surface, and at least one boss on an inner wall of the handle-retaining cavity;

a handle, which is used as a holding portion of the clamping and locating device and has a head portion being held in the handle-retaining cavity; the head portion including at least one mounting hole on the side of the head portion, a button-receiving recess on the top of the head portion, and a sliding groove on the bottom of the button-receiving recess; the button-receiving recess being divided into a first position and a second position, and the mounting hole and the boss being axially mated together to make the handle be pivotally mounted in the handle-retaining cavity; and a lock button being mounted in the button-receiving recess and having a sliding protrusion, which enters into the sliding groove and can slide along the sliding groove; the lock button being switched between the first position and the second position under the control of the sliding protrusion, and the handle being capable of being positioned on the first position and the second position;

wherein the base further includes an elastic fastener disposed on one side of the mounting surface, and the elastic fastener can enter into and be held in a lock opening of the brush plate for fixing the base to the brush plate.

2. The clamping and locating device as claimed in claim 1, wherein the handle further disposes a torsion spring on the side of the head portion, the base further disposes a retaining groove on the bottom of the handle-retaining cavity, the torsion spring can be fixed by the retaining groove and can automatically reset the handle by the resilience performance of the torsion spring after rotating the handle.

3. The clamping and locating device as claimed in claim 2, wherein the handle further disposes a locating groove on the side of the head portion, and the torsion spring is located by the locating groove.

4. The clamping and locating device as claimed in claim 1, wherein the head portion further disposes several positioning grooves, which are formed on the bottom of the button-receiving recess and are perpendicular to the sliding groove; the positioning grooves divide the button-receiving recess into the first position and the second position; the lock button further has a positioning rib, which can be engaged with one of the positioning grooves for positioning the handle on the first position and the second position.

5. The clamping and locating device as claimed in claim 1, wherein the lock button further has a stopping plate on the bottom of the sliding protrusion and an upper portion on the top of the sliding protrusion, and the stopping plate and the upper portion are located on two opposite sides of the sliding groove to prevent the lock button from leaving the sliding groove.

6. The clamping and locating device as claimed in claim 1, wherein the inside of the handle is hollow.

7. The clamping and locating device as claimed in claim 1, wherein the base further includes two bosses, which are respectively and symmetrically located on two opposite inner walls of the handle-retaining cavity; and the head portion disposes two mounting holes, which are respectively located on two opposite sides of the head portion and can be axially mated with the two bosses.

8. A paint brush, which comprises:

a brush plate; and a clamping and locating device, comprising a base including a mounting surface being used to be combined with the brush plate, a handle-retaining cavity formed on the mounting surface, and at least one boss on an inner wall of the handle-retaining cavity;

a handle, which is used as a holding portion of the clamping and locating device and has a head portion being held in the handle-retaining cavity; the head portion including at least one mounting hole on the side of the head portion, a button-receiving recess on the top of the head portion, and a sliding groove on the bottom of the button-receiving recess; the button-receiving recess being divided into a first position and a second position, and the mounting hole and the boss being axially mated together to make the handle be pivotally mounted in the handle-retaining cavity; and a lock button being mounted in the button-receiving recess and having a sliding protrusion, which enters into the sliding groove and can slide along the sliding groove; the lock button being switched between the first position and the second position under the control of the sliding protrusion, and the handle being capable of being positioned on the first position and the second position;

wherein the base further includes an elastic fastener disposed on one side of the mounting surface, and the elastic fastener can enter into and be held in a lock opening of the brush plate for fixing the base to the brush plate.

9. The paint brush as claimed in claim 8, wherein the brush plate disposes two guiding slots respectively located on two opposite edges thereof, and the mounting surface of the base slides into the two guiding slots.

* * * * *